US008646848B2

(12) United States Patent
Hall et al.

(10) Patent No.: US 8,646,848 B2
(45) Date of Patent: Feb. 11, 2014

(54) RESILIENT CONNECTION BETWEEN A PICK SHANK AND BLOCK

(76) Inventors: David R. Hall, Provo, UT (US); Jeff Jepson, Spanish Fork, UT (US); Gary Peterson, Provo, UT (US); Ronald B. Crockett, Payson, UT (US)

( * ) Notice: Subject to any disclaimer, the term of this patent is extended or adjusted under 35 U.S.C. 154(b) by 75 days.

(21) Appl. No.: 13/170,447

(22) Filed: Jun. 28, 2011

(65) Prior Publication Data

US 2011/0254348 A1 Oct. 20, 2011

Related U.S. Application Data

(63) Continuation-in-part of application No. 12/491,848, filed on Jun. 25, 2009, now Pat. No. 8,118,371, and a continuation-in-part of application No. 11/962,497, filed on Dec. 21, 2007, now Pat. No. 8,292,372.

(51) Int. Cl.
*E21C 35/19* (2006.01)

(52) U.S. Cl.
USPC ..... 299/103

(58) Field of Classification Search
USPC ..... 299/100, 102–104, 108, 109, 112 T, 299/112 R
See application file for complete search history.

(56) References Cited

U.S. PATENT DOCUMENTS

| | | | | |
|---|---|---|---|---|
| 2,004,315 A | | 6/1935 | Fean | |
| 2,124,438 A | | 7/1938 | Struk | |
| 2,860,863 A | * | 11/1958 | Bruestle et al. | 299/103 |
| 2,893,714 A | * | 7/1959 | Proctor | 299/109 |
| 2,916,275 A | * | 12/1959 | Bruestle et al. | 299/109 |
| 3,254,392 A | | 6/1966 | Novkov | |
| 3,746,396 A | | 7/1973 | Radd | |
| 3,807,804 A | | 4/1974 | Kniff | |
| 3,830,321 A | | 8/1974 | McKenry | |
| 3,865,437 A | | 2/1975 | Crosby | |
| 3,932,952 A | | 1/1976 | Helton | |
| 3,945,681 A | | 3/1976 | White | |
| 4,005,914 A | | 2/1977 | Newman | |
| 4,006,936 A | | 2/1977 | Crabiel | |
| 4,098,362 A | | 7/1978 | Bonnice | |
| 4,109,737 A | | 8/1978 | Bovenkerk | |
| 4,156,329 A | | 5/1979 | Daniels et al. | |
| 4,199,035 A | | 4/1980 | Thompson | |
| 4,201,421 A | | 5/1980 | Den Besten | |
| 4,277,106 A | | 7/1981 | Sahley | |
| 4,439,250 A | | 3/1984 | Acharya | |
| 4,453,775 A | * | 6/1984 | Clemmow | 299/81.1 |
| 4,465,221 A | | 8/1984 | Schmidt | |

(Continued)

FOREIGN PATENT DOCUMENTS

| | | |
|---|---|---|
| DE | 3500261 | 7/1986 |
| DE | 3818213 | 11/1989 |

(Continued)

*Primary Examiner* — Sunil Singh
(74) *Attorney, Agent, or Firm* — Philip W. Townsend, III

(57) ABSTRACT

In one aspect of the present invention, a pick assembly is configured that comprises a pick shank configured to be press fit directly within a bore of a block. The pick shank comprises an inside and outside surface. The pick comprises a pick head opposite the shank. The shank comprises at least one longitudinal recess extending towards the pick head along the shank from a distal end of the shank. The recess allows the shank to resiliently collapse upon insertion into the bore while maintaining a press fit between the bore and the shank.

16 Claims, 8 Drawing Sheets

(56) References Cited

U.S. PATENT DOCUMENTS

| | | | | |
|---|---|---|---|---|
| 4,484,644 | A | 11/1984 | Cook | |
| 4,489,986 | A | 12/1984 | Dziak | |
| 4,678,237 | A * | 7/1987 | Collin | 299/112 R |
| 4,682,987 | A | 7/1987 | Brady | |
| 4,688,656 | A | 8/1987 | Elfgen | |
| 4,725,098 | A | 2/1988 | Beach | |
| 4,729,603 | A | 3/1988 | Elfgen | |
| 4,765,686 | A | 8/1988 | Adams | |
| 4,765,687 | A | 8/1988 | Parrott | |
| 4,776,862 | A | 10/1988 | Wiand | |
| 4,880,154 | A | 11/1989 | Tank | |
| 4,932,723 | A | 6/1990 | Mills | |
| 4,940,288 | A | 7/1990 | Stiffler et al. | |
| 4,944,559 | A | 7/1990 | Sionnet | |
| 4,951,762 | A | 8/1990 | Lundell | |
| 5,011,515 | A | 4/1991 | Frushour | |
| 5,112,165 | A | 5/1992 | Hedlund | |
| 5,141,289 | A | 8/1992 | Stiffler | |
| 5,154,245 | A | 10/1992 | Waldenstrom | |
| 5,186,892 | A | 2/1993 | Pope | |
| 5,201,569 | A * | 4/1993 | Jurgen | 299/105 |
| 5,251,964 | A | 10/1993 | Ojanen | |
| 5,261,499 | A | 11/1993 | Grubb | |
| 5,311,654 | A * | 5/1994 | Cook | 29/447 |
| 5,332,348 | A | 7/1994 | Lemelson | |
| 5,417,475 | A | 5/1995 | Graham | |
| 5,447,208 | A | 9/1995 | Lund | |
| 5,535,839 | A | 7/1996 | Brady | |
| 5,542,993 | A | 8/1996 | Rabinkin | |
| 5,653,300 | A | 8/1997 | Lund | |
| 5,738,698 | A | 4/1998 | Kapoor | |
| 5,823,632 | A | 10/1998 | Burkett | |
| 5,837,071 | A | 11/1998 | Andersson et al. | |
| 5,845,547 | A | 12/1998 | Sollami | |
| 5,875,862 | A | 3/1999 | Jurewicz | |
| 5,934,542 | A | 8/1999 | Nakamura | |
| 5,935,718 | A | 8/1999 | Demo | |
| 5,944,129 | A | 8/1999 | Jensen | |
| 5,967,250 | A | 10/1999 | Lund | |
| 5,992,405 | A | 11/1999 | Sollami | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,065,552 | A | 5/2000 | Scott | |
| 6,113,195 | A | 9/2000 | Mercier | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,270,165 | B1 | 8/2001 | Peay | |
| 6,341,823 | B1 | 1/2002 | Sollami | |
| 6,354,771 | B1 | 3/2002 | Bauschulte | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen | |
| 6,499,547 | B2 | 12/2002 | Scott | |
| 6,517,902 | B2 | 2/2003 | Drake | |
| 6,585,326 | B2 | 7/2003 | Sollami | |
| 6,685,273 | B1 | 2/2004 | Sollami | |
| 6,692,083 | B2 | 2/2004 | Latham | |
| 6,709,065 | B2 | 3/2004 | Peay | |
| 6,719,074 | B2 | 4/2004 | Tsuda | |
| 6,733,087 | B2 | 5/2004 | Hall | |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin | |
| 6,889,890 | B2 | 5/2005 | Yamazaki et al. | |
| 6,966,611 | B1 | 11/2005 | Sollami | |
| 6,994,404 | B1 | 2/2006 | Sollami | |
| 7,204,560 | B2 | 4/2007 | Mercier | |
| 2002/0175555 | A1 | 11/2002 | Mercier | |
| 2003/0141350 | A1 | 7/2003 | Noro et al. | |
| 2003/0209366 | A1 | 11/2003 | McAlvain | |
| 2003/0234280 | A1 | 12/2003 | Cadden et al. | |
| 2004/0026983 | A1 | 2/2004 | McAlvain | |
| 2004/0065484 | A1 | 4/2004 | McAlvain | |
| 2005/0159840 | A1 | 7/2005 | Lin et al. | |
| 2006/0237236 | A1 | 10/2006 | Sreshta | |
| 2007/0013224 | A1 * | 1/2007 | Stehney | 299/104 |
| 2008/0036281 | A1 * | 2/2008 | Hall et al. | 299/105 |

FOREIGN PATENT DOCUMENTS

| | | |
|---|---|---|
| DE | 4039217 | 6/1992 |
| DE | 19821147 | 11/1999 |
| DE | 10163717 | 5/2003 |
| EP | 0295151 | 6/1988 |
| EP | 0412287 | 7/1990 |
| GB | 2004315 | 3/1979 |
| GB | 2037223 | 11/1979 |
| JP | 3123193 | 1/2001 |

* cited by examiner

101

RESILIENT CONNECTION BETWEEN A PICK SHANK AND BLOCK

CROSS REFERENCE TO RELATED APPLICATIONS

This application is a continuation-in-part of U.S. Pat. No. 8,118,371, application Ser. No. 12/491,848, which issued on Feb. 21, 2012 filed Jun. 25, 2009, and is a continuation-in-part of U.S. Pat. No. 8,292,372 application Ser. No. 11/962,497, which issued on Oct. 23, 2012 filed Dec. 21, 2007. Both of these patents are herein incorporated by reference for all that they disclose.

BACKGROUND OF THE INVENTION

Formation degradation, such as asphalt milling, mining, or excavating, may result in wear on attack tools. Consequently, many efforts have been made to efficiently remove and replace these tools.

U.S. Pat. No. 6,585,326 to Sollami, which is herein incorporated by reference for all that it contains, discloses a bit holder with its mating bit block utilizing a slight taper in the bit block bore, and a tapered shank on the bit holder that includes a second larger diameter tapered distal segment that combines with an axially oriented slot through the side wall of the bit holder shank to allow a substantially larger interference fit between the distal tapered shank segment and the bit block bore than previously known. When inserting the bit holder in the bit block bore, the distal first tapered segment resiliently collapses to allow insertion of that segment into the bit block bore. A second shank tapered portion is disclosed axially inwardly of the first distal tapered portion. The dual tapered shank allows the insertion of the bit holder in the bit block with an interference fit that provides a secure mounting of the bit holder in the bit block.

U.S. Pat. No. 6,685,273 to Sollami, which is herein incorporated by reference for all that it contains, discloses a bit assembly for road milling, mining, and trenching equipment that includes a streamlined tip assembly that is a combination of conical and cylindrical in shape and devoid of protrusions or annular indentations that might impede the flow of removed material over and around the bit assembly or provide space for removed material to become clogged or imbedded on the tip assembly. The portion of the bit block which mounts on a drum or endless chain extends from a cylindrical portion of the bit block and provides opposed angled shoulders which extend downwardly and away from a central ridge on the bit block to again provide for efficient flow of removed material over and around the bit block.

U.S. Pat. No. 3,751,115 to Proctor, which is herein incorporated by reference for all that it contains, discloses a combination of a shanked tool and a holder therefore the holder being formed with a socket for receiving the tool shank and with a resilient latch biased in a direction transverse to the operating direction for engaging in a recess in the side of the tool shank.

U.S. Pat. No. 3,468,553 to Ashby et al., which is herein incorporated by reference for all that it contains, discloses a tool retaining device having a metal locking pin bonded in a groove of a resilient backing member. One end of the backing member is formed with an integral end sealing cap and the other end has a projecting spigot onto which a further end sealing cap is fitted when the device is fitted in a tool holder. In the fitted position, the two sealing caps respectively seal the ends of the device and thereby prevent the ingress of foreign matter.

In accordance to U.S. Pat. No. 3,865,437 to Crosby, which is herein incorporated by reference for all that it contains, a mining tool of the type in which a pick style bit is rotatably mounted in a bore in a support member and is retained therein by retaining means integrally formed on the bit. The retaining means advantageously takes the form of at least one radial projection on the rear end of the bit shank with the bit shank being slotted to impart radial resilience thereto so the bit can be assembled with the support member and readily disassembled therefrom while being retained therein during work operations. The support member may comprise a support block adapted for being fixed to a driver with a sleeve rotatable in a bore in the block and in turn, rotatably receiving the bit. The sleeve may be slotted axially from the rear end so as to have later resilience and be formed with one or more radial projections or protrusions at the rear end so that the sleeve, also, is releasably retained in the block by retaining means integral therewith.

Examples of degradation tools from the prior art are disclosed in U.S. Pat. No. 2,989,295 to Prox Jr., U.S. Pat. No. 6,397,652 B1 to Sollami, U.S. Pat. No. 6,685,273 B1 to Sollami, which are all herein incorporated by reference for all they contain.

BRIEF SUMMARY OF THE INVENTION

In one aspect of the present invention, a pick comprises a shank configured to be press fit directly within a bore of a block. The shank comprises an inside and outside surface. The pick comprises a head opposite the shank. The shank comprises at least one longitudinal recess extending towards the head along the shank from a distal end of the shank. The recess allows the shank to resiliently collapse upon insertion into the bore while maintaining a press fit between the bore and the shank.

The recess may be formed on the inside surface of the shank. The recess may be formed on the outside surface of the shank. The outside surface may be continuous. The inside surface may be continuous. The recess may form an interruption in the outside surface of the shank. The recess may form an interruption in the inside surface of the shank. The recess may be formed through part of a thickness between the inside and outside surfaces. The inside and outside surfaces may comprise a plane connected by a wall of the recess. The recess may be configured to relieve tension between the shank and the bore.

The shank may comprise a first thickness and a second thickness along the length of the shank. The first and second thicknesses may be configured to secure the shank within the bore at a proximal end and distal end of the shank. The first and second thicknesses may be configured to increase compliancy of the shank.

Additionally, the shank may comprise a tapered region on the outside surface that is configured to abut a tapered region on an inner surface of the bore. The tapered shank region and the tapered bore region may be configured to be complementary. The shank may be hollow. The recess may comprise a first and second recess wall connected by a spring formed in a material of the shank. The shank may be configured to remain substantially stationary with respect to the bore.

The head may comprise a cemented metal carbide substrate bonded to sintered polycrystalline diamond. The substrate may be bonded to a bolster. The bolster may be brazed to a body of the pick. At least one void may be formed along a non-planar interface between the bolster and the body. The non-planar interface may be configured to prevent residual thermal stress formation.

In another aspect of the present invention, a block is mounted to a driving mechanism. The block comprises a longitudinal recess extending along a length of a bore. The recess is configured to resiliently expand the bore upon insertion of a shank while forming a press fit between the bore and the shank.

The recess may be configured proximate a rearward end of the bore. The recess may be configured to face away from a formation that is being degraded. The recess may be formed on an inner surface of a block. The recess may form an interruption within the inner surface of the block. The inner surface of the block may be configured to be continuous. The recess may be configured on an outer surface of the block. The recess may form an interruption within the outer surface of the block. The outer surface of the block may be configured to be continuous.

A thickness may be formed between the inner and outer surface of the bore. The recess may be formed through part of the thickness. Additionally, the recess may comprise a first and second recess wall that is connected by a spring formed in a material of the block. The recess may connect the outer surface of the bore to the inner surface.

The block may be configured to be hollowed out. The bore in the block may connect a front end of the block to a back end.

In another aspect of the present invention, a shank comprises at least one substantially annular spring clip disposed about an outside surface of the shank. The spring clip may be configured to collapse upon insertion into a bore of a block. The spring clip may be configured to decrease in diameter when inserted into the bore. The spring clip may be disposed at a distal end of the shank. The spring clip may comprise a larger diameter than the bore of the block. The spring clip may comprise a larger diameter than the outside surface of the shank. The spring clip may be configured to axially secure the pick within the bore.

The shank may comprise a proximal thickness and a distal thickness along a length of the shank. The distal thickness may be configured to be thinner than the proximal thickness. The spring clip may be configured to be concentric with the distal thickness. The proximal thickness may be disposed forward of the spring clip and configured to prevent rotation of the shank within the bore at a proximal end of the shank. The distal thickness may be configured to decrease friction between the outside surface of the shank and the inner surface of the bore.

The block may be mounted to a driving mechanism. The driving mechanism may comprise a rotary degradation drum, saw, chain, bucket, plow, excavator, or combination thereof.

DETAILED DESCRIPTION OF THE INVENTION AND THE PREFERRED EMBODIMENT

Figure 1:
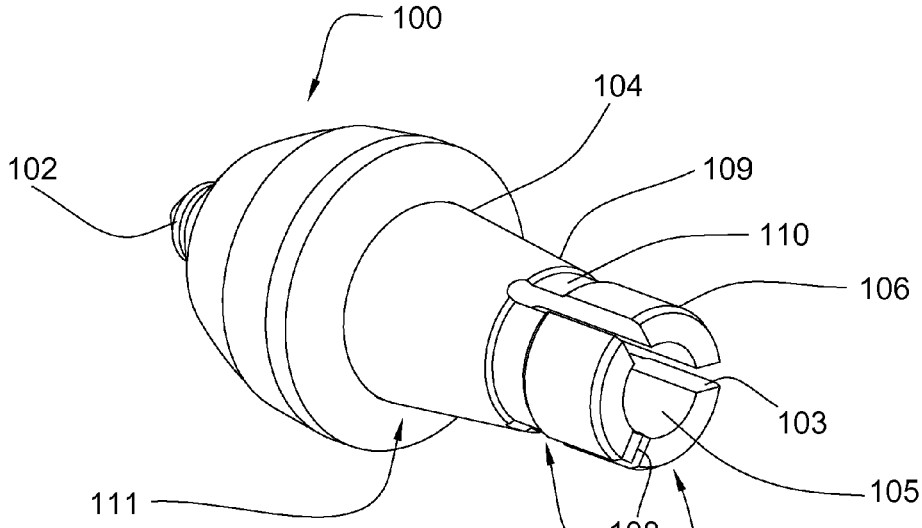
FIG. 1 is a perspective diagram of an embodiment of a pick.
Figure 2:
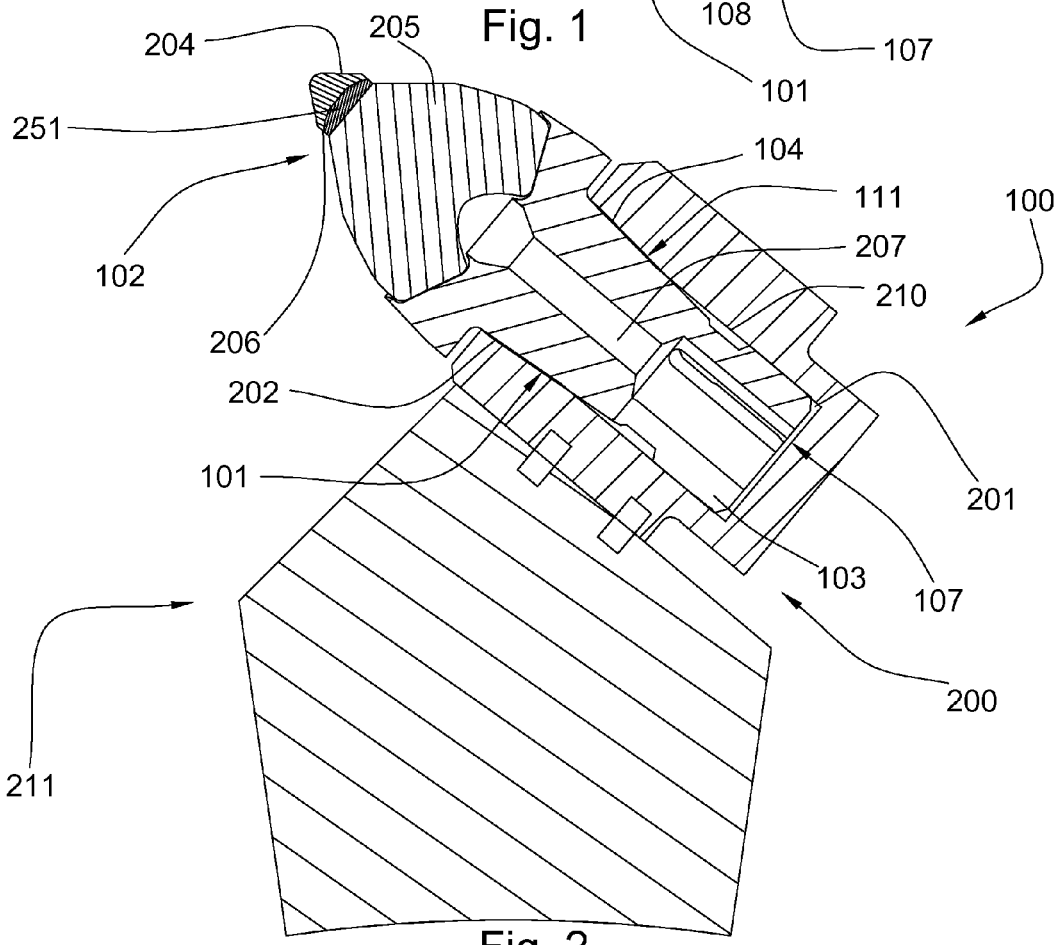
FIG. 2 is a cross-sectional diagram of an embodiment of a pick secured within a block attached to a driving mechanism.

Referring now to the figures, FIG. 1 is a perspective diagram of an embodiment of a pick 100, and FIG. 2 is a cross-sectional diagram of the pick 100 secured within a block 200 of a driving mechanism 211. The pick 100 comprises a shank 101 and a head 102 opposite the shank 101. Additionally, the shank 101 may comprise an inside surface 105 and an outside surface 106. The shank 101 may be hollow and configured to be press fit directly within a bore 201 of the block 200. The shank 101 may comprise a tapered region 104, preferably configured on the outside surface 106 of the shank 101. The tapered shank region 104 may occur at a four to seven degree angle from the shank's longitudinal axis. Additionally, the bore 201 of the block 200 may comprise a tapered region 202 on an inner surface 210 of the bore 201. The tapered shank region 104 and the tapered bore region 202 may be configured to be complementary. When the shank 101 is inserted into the bore 201, the tapered shank region 104 may be configured to abut the tapered bore region 202 forming the press fit directly between the two regions 104, 202.

The pick 100 may comprise a hollow shank 101. Less material may be used to form the pick 100 which may result in a less expensive tool compared to one with a solid shank. Furthermore, a decrease in material may increase the compliancy of the shank 101. The increased compliancy may aid in easier removal of the shank 101 from the bore 201. Easier shank removal may reduce the time required to replace worn out picks 100.

Additionally, the shank 101 may comprise a longitudinal recess 103 extending towards the head 102 along the shank 101 from a distal end 107 of the shank 101. The recess 103 may extend to the distal end 107 of the shank 101 or proximate the distal end 107. The recess 103 may be formed through the use of a band saw, CNC machine, or combinations thereof. In some embodiments, the recess 103 may be forged into the shank 101. The shank 101 may comprise a diameter that is larger than a diameter of the bore 201. As the shank 101 is inserted into the bore 201, the forces exerted on the recess 103 may force the shank 101 diameter to contract, resiliently collapsing the shank 101 into the bore 201. The reduced shank 101 diameter may sustain the press fit between the shank 101 and the bore 201 while decreasing the magnitude of the forces exerted between the shank 101 and the bore 201. The decreased forces may include tension forces exerted between the shank 101 and the bore 201. The recess 103 may aid in forming a more secure press fit between the pick 100 and the bore 201, further securing the shank 101 within the bore 201 during operation of the pick 100.

In some embodiments, the recess 103 may be formed within a fraction of a thickness 108 formed between the inside and outside surfaces 105, 106. The recess 103 may extend through a significant fraction through the thickness 108, an insignificant fraction, or completely through the thickness 108. The recess 103 may comprise a height equal in magnitude to the thickness 108 formed between the inside and outside surfaces 105, 106. A wall of the recess 103 may comprise a plane to connect the inside surface 105 to the outside surface 106 of the shank 101.

The head 102 may comprise an impact tip 204 attached to a bolster 205. The impact tip 204 may comprise a super hard material bonded to a carbide substrate 251 at a first non-planar interface 206. Preferably, the super hard material may comprise sintered polycrystalline diamond with a binder concentration of 1 to 40 weight percent, but may also comprise cubic boron nitride, silicon bonded diamond, layered diamond, infiltrated diamond, thermally stable diamond, natural diamond, vapor deposited diamond, physically deposited diamond, monolithic diamond, polished diamond, coarse diamond, fine diamond, non-metal catalyzed diamond, cemented metal carbide, chromium, titanium, aluminum, tungsten, or combinations thereof.

The press fit occurring between the shank 101 and the bore 201 of the block 200 may keep the shank 101 substantially stationary with respect to the bore 201. In the preferred embodiment, the impact tip 204 may comprise polycrystalline diamond. The utilization of polycrystalline diamond may greatly increase the tip's hardness and the tip's ability to withstand wear when compared against carbide tips. Whereas the impact tip 204 previously wore significantly faster than the rest of the pick 100, the diamond enhanced tips 204 wears at a same rate or a slower rate than other components of the pick 100. In prior years, the head 102 was configured to rotate providing an even wear to the impact tip 204. However, diamond enhanced tips are so effective at reducing wear that a rotary shank is less critical. In fact, rotary shanks tend to wear faster than the diamond enhanced impact tips, thus, a shank that is fixed within the bore of the block is believed to extend the life of the overall pick.

The shank 101 may comprise a first thickness 109 and a second thickness 110 along a length of the shank 101. The first and second thicknesses 109, 110 may be configured to secure the shank 101 within the bore 201 at a proximal end 111 and the distal end 107 of the shank 101. The first thickness 109 may be larger in magnitude than the second thickness 110. A reduction in magnitude may occur at an intersection of the first and second thicknesses 109, 110. The reduction may form an interruption in the press fit and a surface contact between the shank 101 and the bore 201. The interruption may span an entire area of the second thickness 110. A friction force occurring between the bore 201 and the shank 101 may decrease. Furthermore, the interruption in the press fit may increase the shank's compliancy. The decreased friction and increased compliancy may result in easier removal of the shank 101 from the bore 201.

FIGS. 3*a*-3*d* are cross-sectional diagrams of embodiments of the pick 100. The head 102 may comprise the super hard material bonded to the carbide substrate at the first non-planar interface 206. The carbide substrate may comprise cemented metal. The substrate may be bonded to a bolster 205, and the bolster 205 may be brazed to a body 301 of the pick 100 at a second non-planar interface 270. At least one void 300 or interruption may be formed between the bolster 205 and the body 301 along the second non-planar interface 270. The void 300 may be formed in a bolster material, a body material, or a combination thereof. The void 300 may provide residual stress relief generated from the bonding process due to difference in the thermal expansion coefficients of diamond and cemented metal carbides.

Figure 3A:
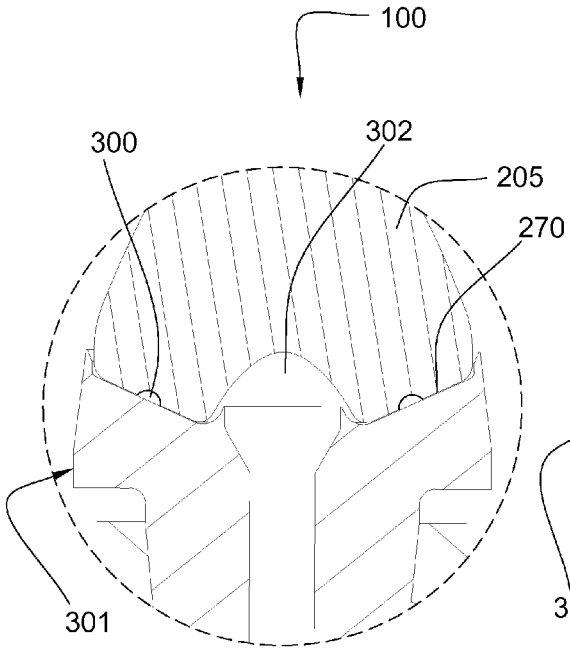
FIG. 3*a* is a cross-sectional diagram of an embodiment of a pick.
Figure 3B:
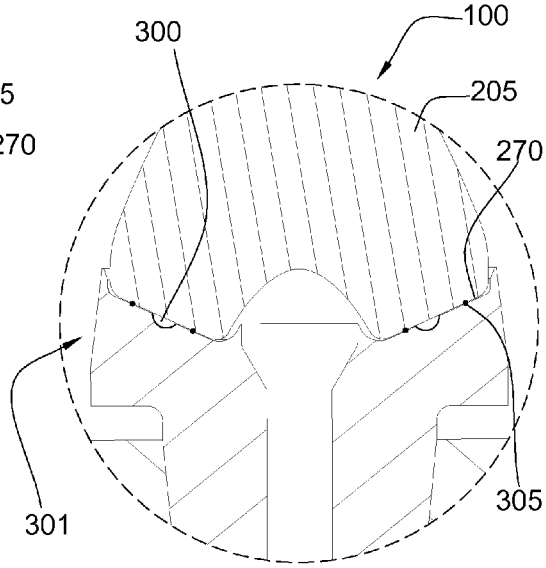
FIG. 3*b* is a cross-sectional diagram of another embodiment of a pick.
Figure 3C:
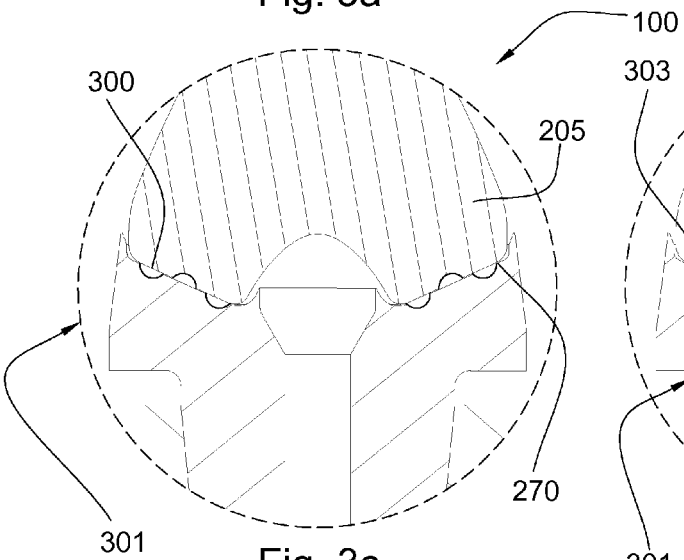
FIG. 3*c* is a cross-sectional diagram of another embodiment of a pick.

FIGS. 3*a*-3*c* disclose the second non-planar interface 270 occurring along an angled portion of the bolster 205 and an inversely angled portion of the body 301. The angled bolster portion and angled shank portion may further aid in preventing residual thermal stress formation. The void 300 may be configured along the second non-planar interface 270. The void 300 may be configured at a center 302 of the second non-planar interface 6270. The void 300 may comprise an annular groove. In some embodiments, the center 302 of the interface void and the annular groove void may be used in conjunction.

Figure 3D:
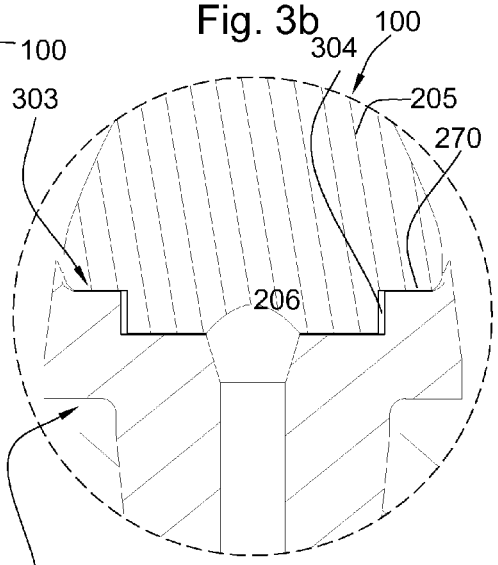
FIG. 3*d* is a cross-sectional diagram of another embodiment of a pick.

In other embodiments, the second non-planar interface 270 may occur along a step formation 303 in the bolster 205 and a complimentary step formation 303 in the body 301. At least one void 304 may be formed proximate the step of the second non-planar interface 270 as shown in FIG. 3*d*. The void 304 may accommodate the different expansion rates that occur at the second non-planar interface 270 amongst different materials.

A protrusion 305 may be formed in the bolster 205 or the body 301 and is configured to provide a cavity between the bolster 205 and the body 301. This cavity may affect the bonding material's thickness along the second non-planar interface 270. Preferably, the bonding material may be thicker towards the periphery of the second non-planar interface 270. This may accommodate the stress propagation that may occur down the pick's sides during impact.

Figure 4:
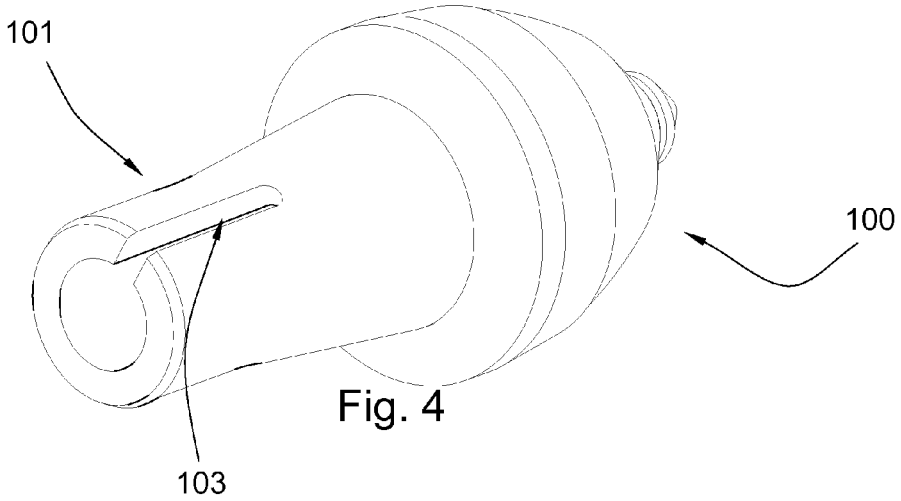
FIG. 4 is a perspective diagram of an embodiment of a pick.

FIG. 4 discloses a single recess 103 formed in the shank 101. While the recess is shown spanning the entire thickness of the shank wall, the recess may penetrate only a fraction of the thickness.

Figure 5:
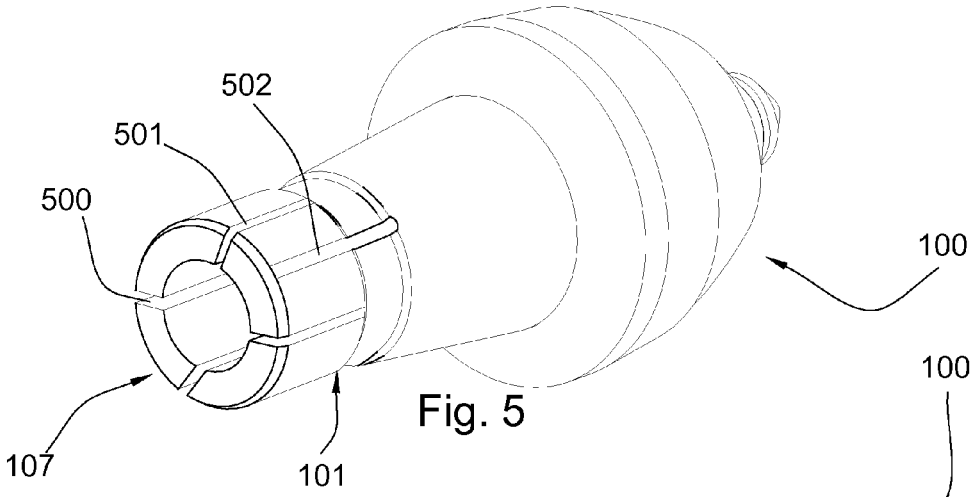
FIG. 5 is a perspective diagram of an embodiment of a pick.

FIG. 5 is a perspective diagram of the pick 100. A plurality of recesses 500, 501, 502 may be configured along the shank 101. Some recesses 500, 501 may extend to the distal end 107 while other recesses 502 may only extend proximate the distal end 107. In some embodiments, the width of each recess 500, 501, 502 may decrease as the total number of recesses 500, 501, 502 increases. In some embodiments, the recesses 500, 501, 502 may comprise different widths.

Figure 6:
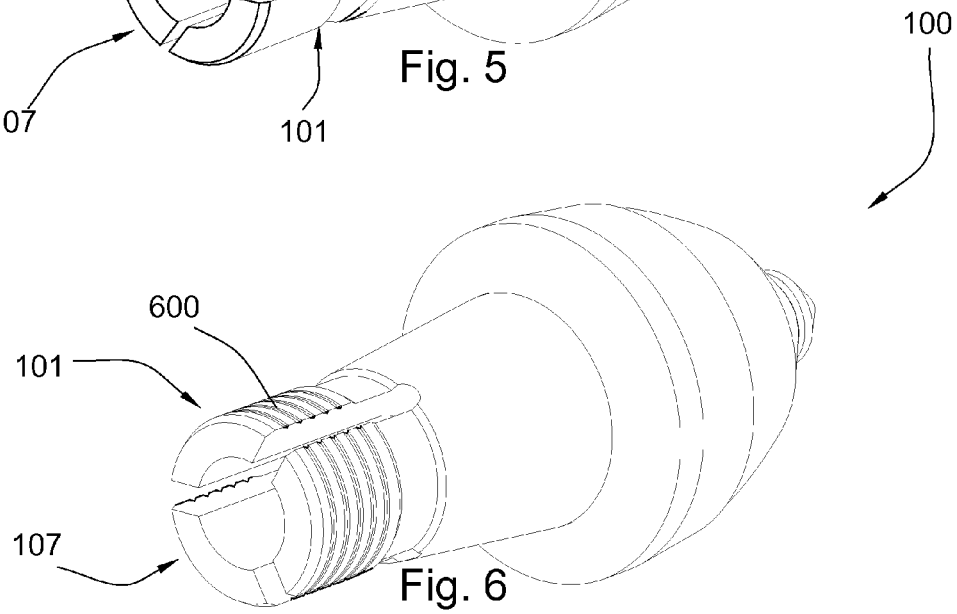
FIG. 6 is a perspective diagram of an embodiment of a pick.

FIG. 6 discloses a plurality of threads 600 formed in the distal end 107 of the shank 101. A complementary plurality of threads may be configured along the inner surface of the block's bore. The shank 101 may resiliently collapse into the bore as complementary components are threaded together. The recesses may give the shank compliancy that allows for quick removal while the threads may lock the pick axially within the bore. During a milling operation, the centrifugal forces urge the pick out of the block's bore and the compliancy for easier removal lessens the press fit's ability to withstand this centrifugal forces. However, the threads may resist the centrifugal forces and ensure that the shanks remains within the block.

Figure 7:
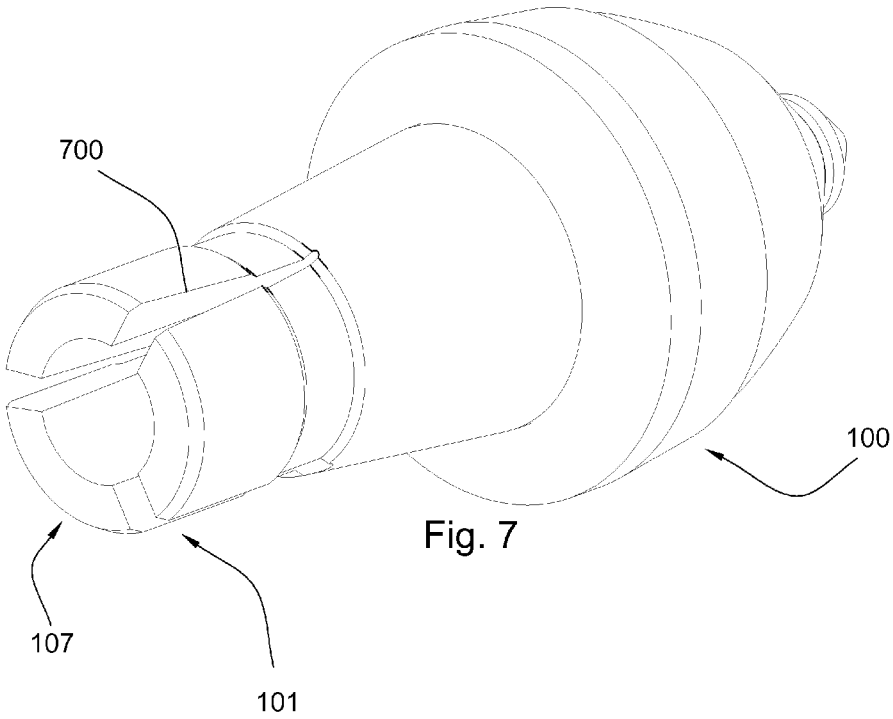
FIG. 7 is a perspective diagram of an embodiment of a pick.

FIG. 7 discloses the distal end 107 of the shank comprising at least one tapering recess 700. The tapering may increase outwardly as the recess 700 extends towards the distal end 107. The tapering recess 700 may increase the compliancy of the shank 101 proximate the distal end 107.

Figure 8:
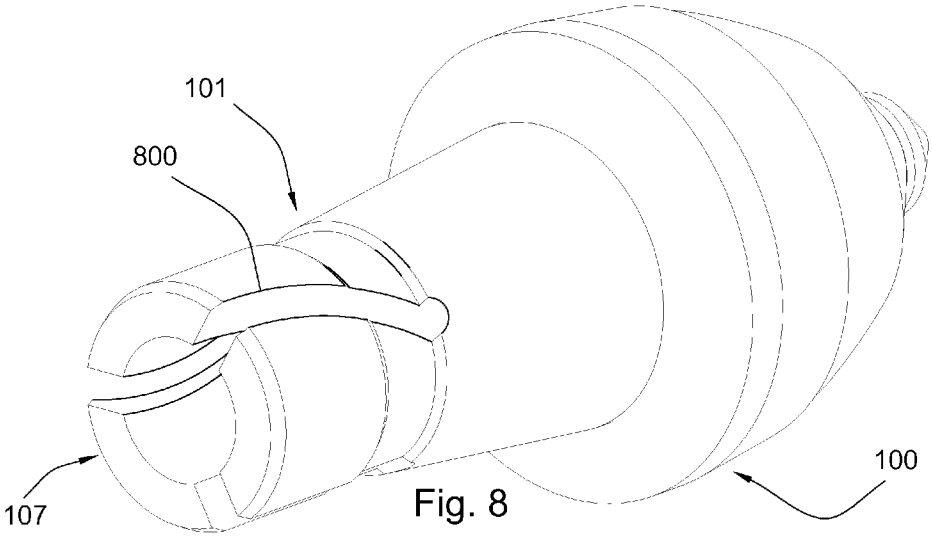
FIG. 8 is a perspective diagram of an embodiment of a pick.

FIG. 8 discloses recess 800 arranged spirally with respect to the center of the shank 101. The present embodiment may increase compliancy of the shank portion 101 that is proximate the distal end 107. The increased compliancy of both embodiments may increase the ease of insertion and removal of the shank 101 from the bore of the block.

Figure 9:
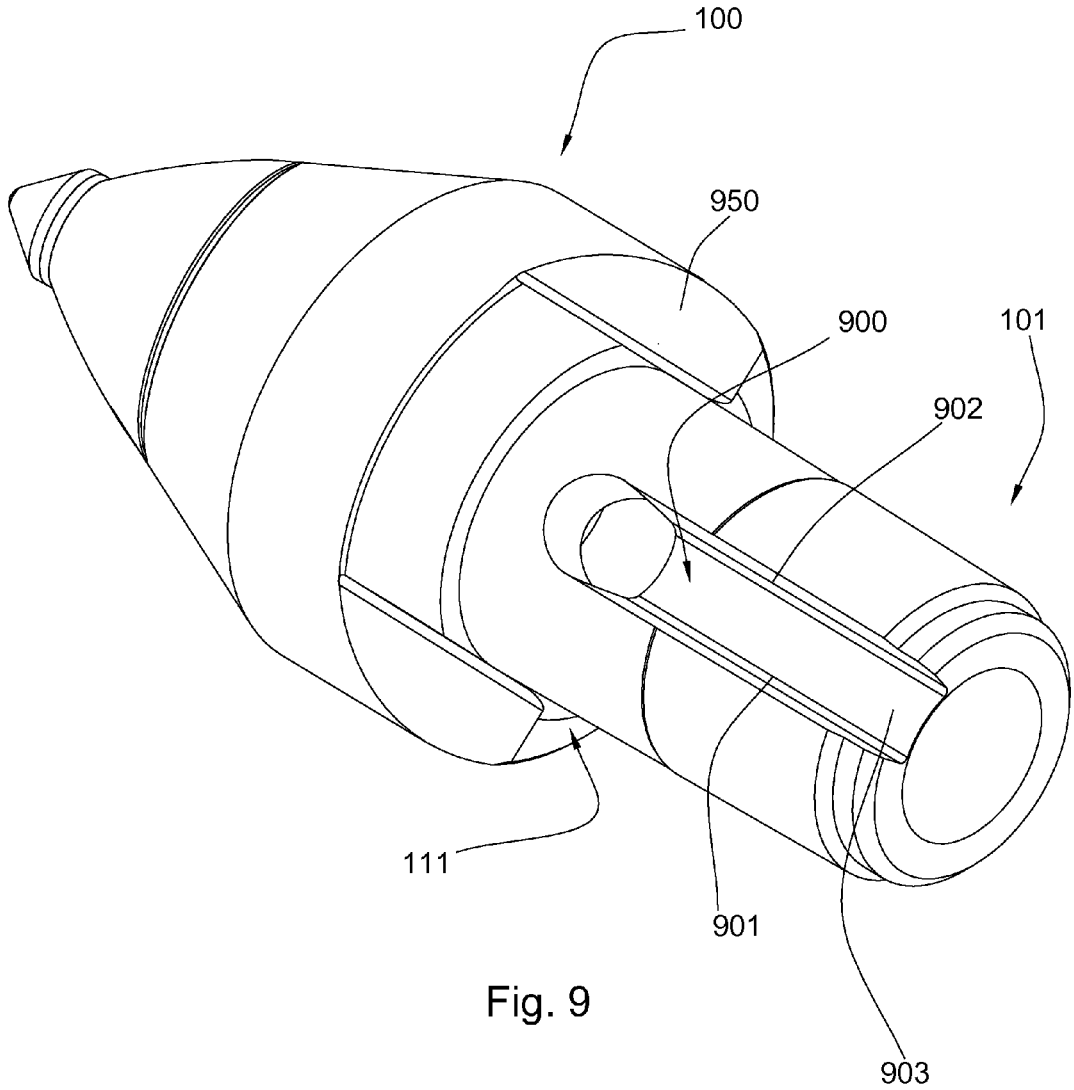
FIG. 9 is a perspective diagram of an embodiment of a pick.

FIG. 9 discloses the recess 900 comprising a first and second recess wall 901, 902. The first and second recess walls 901, 902 may be connected by a spring 903 formed in a material of the shank 101. The spring 903 may adjust the resiliency of the shank. The shank's stiffness may be engineered through the spring 903.

At least one release groove 950 may be configured near the proximal end 111 of the shank 101. The release groove may provide a place to insert removal tongs to pry the pick out of the block.

Figure 10A:
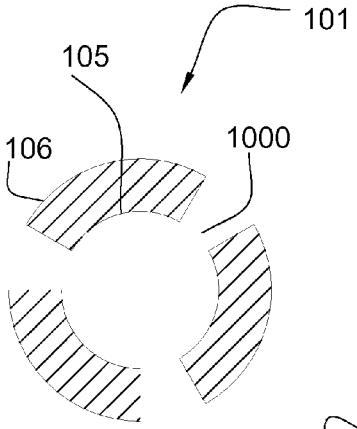
FIG. 10*a* is a cross-sectional diagram of an embodiment of a shank.
Figure 10B:
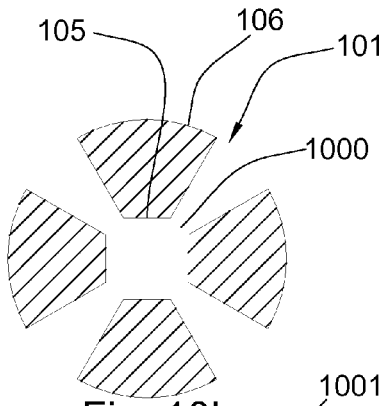
FIG. 10*b* is a cross-sectional diagram of another embodiment of a shank.
Figure 10C:
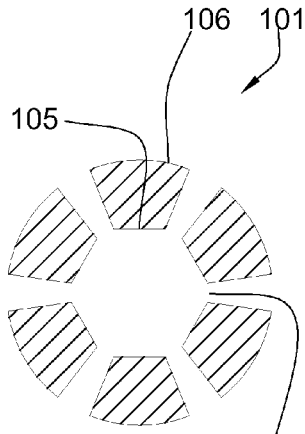
FIG. 10*c* is a cross-sectional diagram of another embodiment of a shank.
Figure 10D:
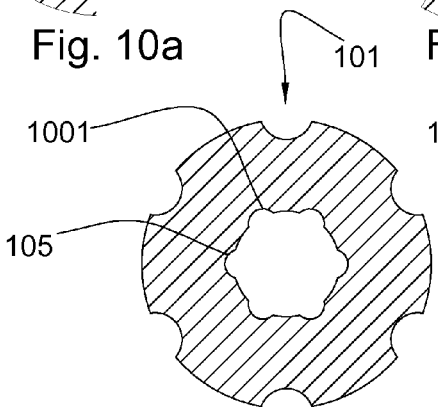
FIG. 10*d* is a cross-sectional diagram of another embodiment of a shank.
Figure 10E:
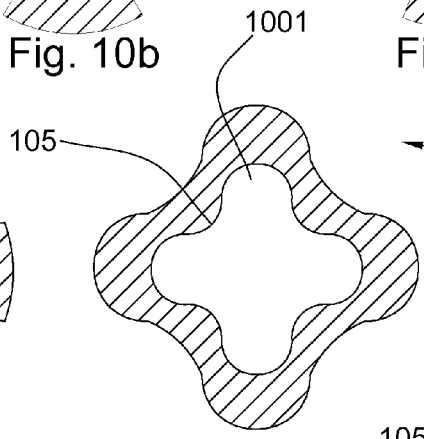
FIG. 10*e* is a cross-sectional diagram of another embodiment of a shank.
Figure 10F:
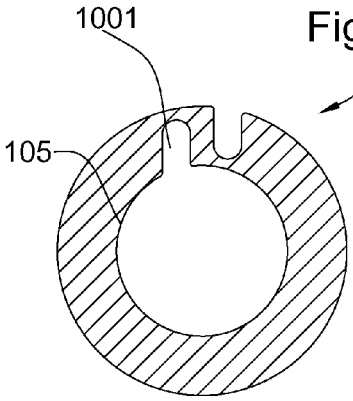
FIG. 10*f* is a cross-sectional diagram of another embodiment of a shank.
Figure 10G:
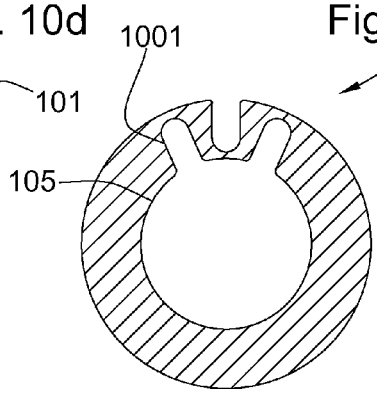
FIG. 10*g* is a cross-sectional diagram of another embodiment of a shank.

FIGS. 10*a*-10*h* disclose various embodiments of cross-sections of the shank 101. The recesses may be formed on the inside or outside surface 105, 106 of the shank. FIGS. 10*a*-10*c* disclose a recess forming an interruption 1000 to the inside surface's diameter. The interruption 1000 may extend completely through a thickness formed between the inside and outside surfaces 105, 106. In some embodiments, the recess 1001 may extend only partially through the thickness.

FIGS. 10*d*-10*h* disclose the inside surface 105 as continuous. The continuous inside surface 105 may maintain or increase the resiliency of the shank 101 compared to the inside surface 105 with the interruption 1000.

Figure 10H:
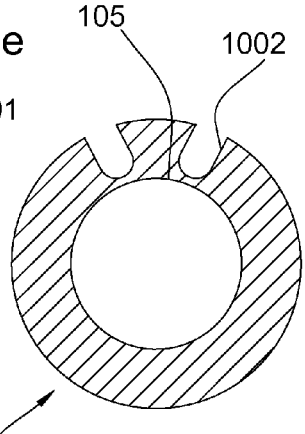
FIG. 10*h* is a cross-sectional diagram of another embodiment of a shank.

FIG. 10*h* discloses the recesses 1002 only formed in the outside surface 106. In some embodiments, the outside surface 106 of the shank 101 may be continuous, and the recess may form an interruption in the outside surface's continuous diameter.

Figure 11:
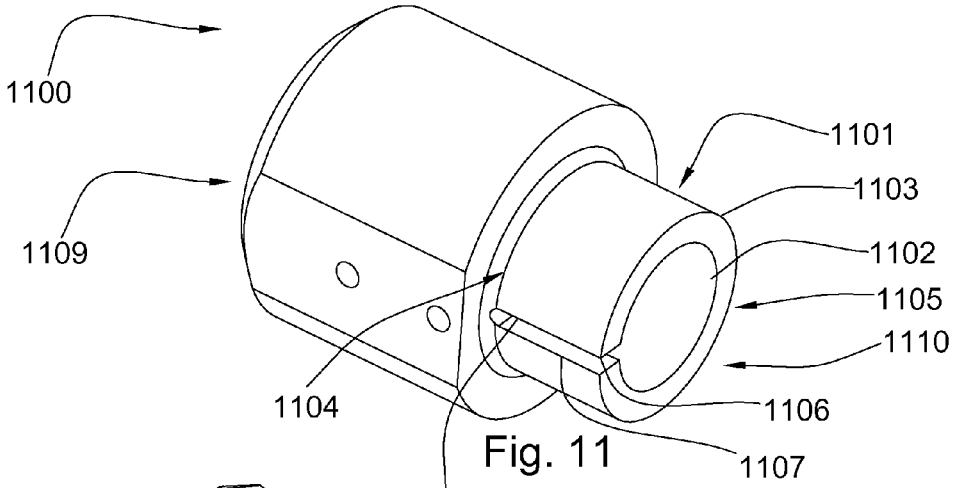
FIG. 11 is a perspective diagram of an embodiment of a block.
Figure 12:
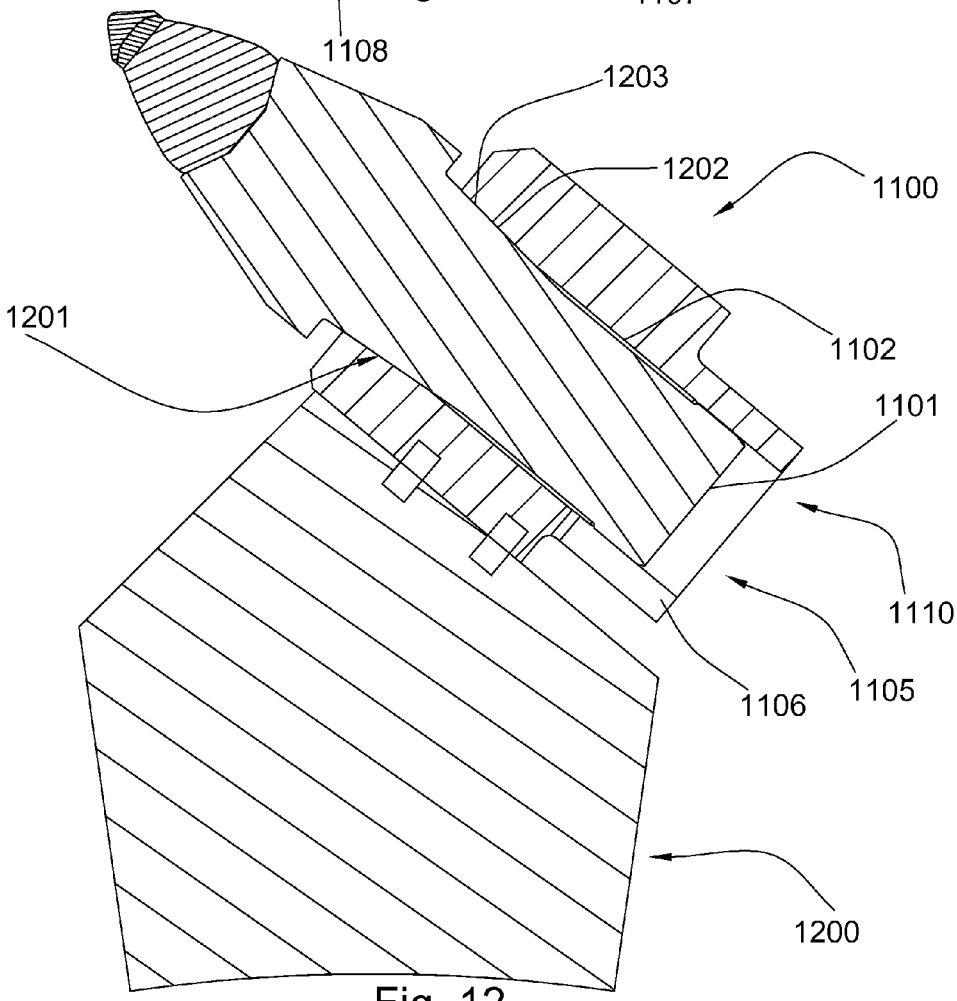
FIG. 12 is a cross-sectional diagram of an embodiment of a pick secured within a block attached to a driving mechanism.

FIG. 11 is a perspective diagram of a block 1100, and FIG. 12 is a cross-sectional diagram of the block 1100 mounted to a driving mechanism 1200. The block 1100 may be hollow and comprise a bore 1101 that is configured to receive a shank 1201. The block 1100 may comprise an inner and outer surface 1102, 1103 and a forward and rearward end 1104, 1105. The rearward end 1105 may be disposed closer to the driving mechanism 1200. The block 1100 may comprise longitudinal recess 1106 extending along a length of the bore 1101. The recess 1106 may be configured to resiliently expand the bore 1101 upon insertion of the shank 1201 into the bore 1101. The bore 1101 may expand while maintaining a press fit between the bore 1101 and the shank 1201.

The recess 1106 may be configured proximate the rearward end 1105 of the bore 1101 and configured to face away from a formation that is being degraded. This may prevent degraded debris from becoming lodged within the recess 1106.

The block may comprise a tapered region 1202 on the inner surface 1102 of the bore 1101. The tapered bore region 1202 may be configured to abut a tapered region 1203 on an outside surface of the received shank 1201. The tapered bore region 1202 and the tapered shank region 1203 may be configured to complement one another. The tapered bore and shank regions 1202, 1203 may be configured to increase surface to surface contact between the shank 1201 and the bore 1101. Additionally, the tapered bore and shank regions 1202, 1203 may be configured to increase friction exerted between the inner surface 1102 of the bore 1101 and the outside surface of the received shank 1201. The increased surface contact and friction may be configured to restrain the received shank 1201 within the bore 1101 and keep the shank 1201 substantially stationary with respect to the bore 1101 during operation of the driving mechanism 1200. The recess 1106 may be configured to comprise a resiliency to relieve tension between the inner surface 1102 of the bore 1101 and the outside surface of the received shank 1201.

The recess 1106 may be formed on the inner surface 1102 of the bore 1101 and may form an interruption within the inner surface 1102. In some embodiments, the recess 1106 may be formed on the outer surface 1103 of the block 1100 and the recess 1106 may form an interruption on the outer surface 1103. The recess 1106 may be formed through part of a thickness between the inner and outer surface 1102, 1103 of the bore 1101. The recess 1106 may comprise a first and second recess wall 1107, 1108 connected by a spring formed in a material of the block 1101. Preferably, the recess 1106 may be configured to comprise a plane connecting the inner and outer surfaces 1102, 1103 of the block 1100.

The bore 1101 may extend completely through the block 1100 connecting a front end 1109 of the block 1100 to a back end 1110. The shank 1201 may be accessible through the back end 1110 of the block 1101. The accessibility may ease replacing the shank 1201 and, thus, decrease the replacement time.

Figure 13:
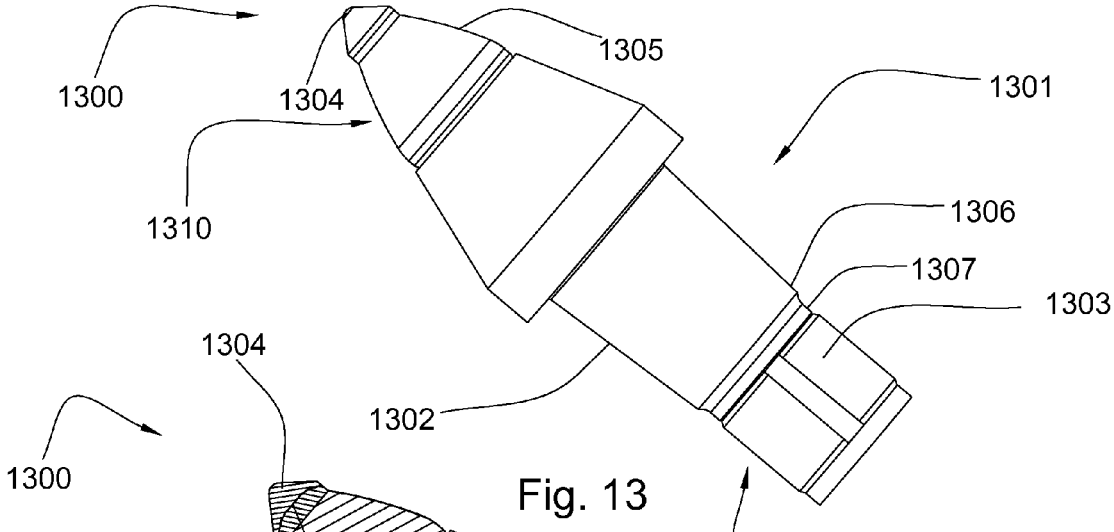
FIG. 13 is a perspective diagram of an embodiment of a pick.
Figure 14:
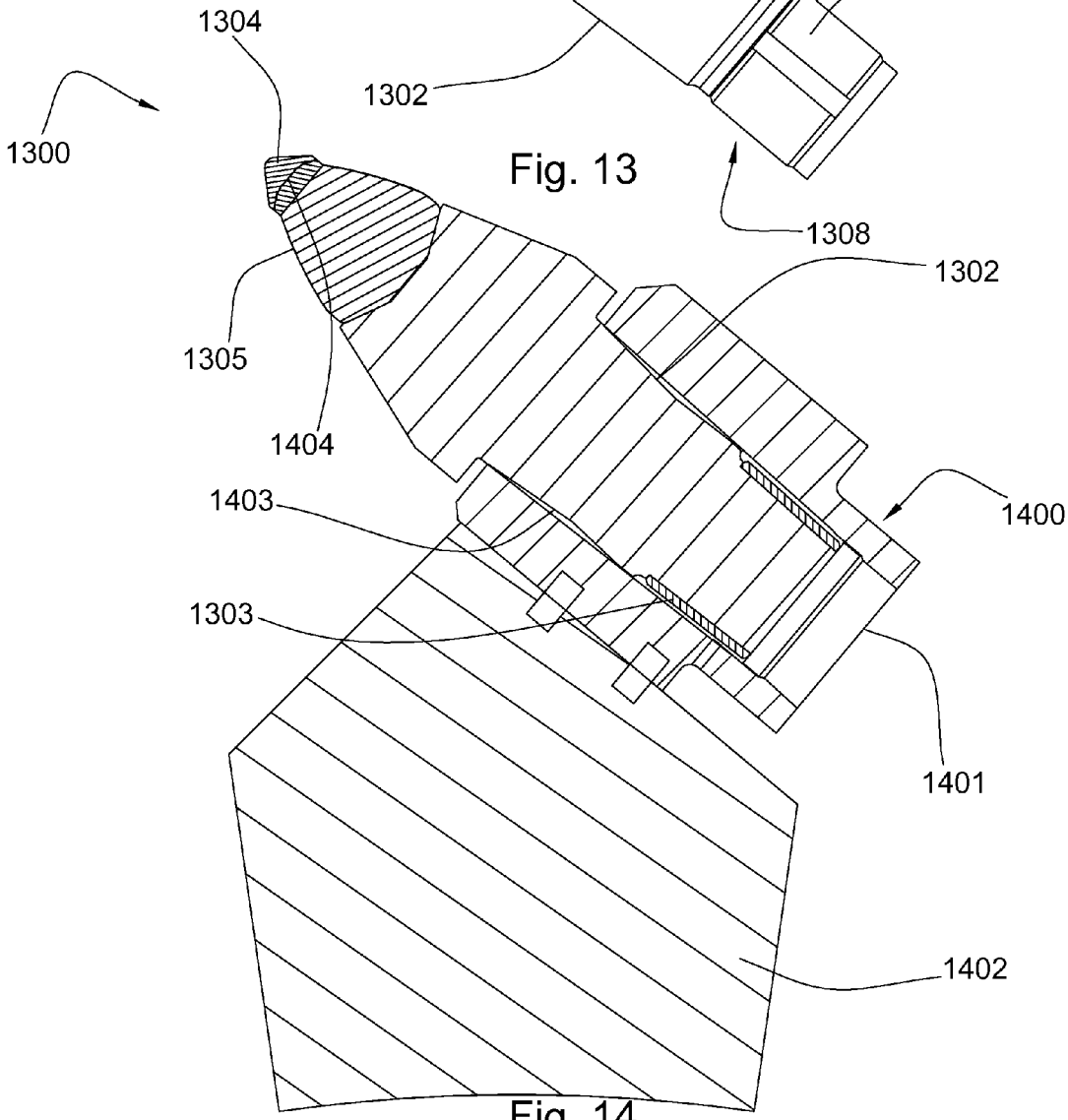
FIG. 14 is a cross-sectional diagram of an embodiment of a pick secured within a block attached to a driving mechanism.

FIG. 13 discloses another embodiment of a pick 1300, and FIG. 14 discloses a cross-sectional diagram of the pick 1300 secured to a block 1400. A shank 1301 may be configured to be inserted directly into a bore 1401 of the block 1400 of a driving mechanism 1402. The shank 1301 may comprise an outside surface with a tapered region 1302. Additionally, the bore 1401 may comprise a complimentary tapered region 1403 on its inner surface. The tapered shank region 1302 and tapered bore region 1403 may be configured to abut against each other when the shank is inserted into the bore.

The shank 1301 may also comprise at least one substantially annular spring clip 1303 disposed about the outside surface of the shank 1301. The spring clip 1303 may be located towards the distal end of the shank and may comprise an outer diameter that is larger than an inner diameter of the bore 1401. The spring clip's diameter may also be larger than a diameter of the outside surface of the shank 1301. The spring clip 1303 may comprise a recess that is configured to increase the clip's resiliency such that the clip is configured to collapse around the shank 1301 upon insertion into the bore. The clip's outer diameter may decrease upon insertion, but exert an outerward force upon the bore's inner diameter thereby axially securing the pick 1300 within the bore 1401.

The head 1302 may comprise an impact tip 1304 attached to a bolster 1305. The impact tip 1304 may comprise a super hard material bonded to a carbide substrate at a non-planar interface 1404. Preferably, the carbide substrate may comprise cemented metal carbide and the super hard material may comprise a sintered polycrystalline diamond. Due to the diamond enchanced tip's superior performance, the tip may wear slower than other components of the pick. Prior art picks are generally configured to rotate to prolong the life of their impacts tips. However, the diamond enhanced tips may wear slower than the rotary shanks of the prior art, therefore, the picks of the present invention are restricted from rotation to prevent shank wear, which may cause the pick overall to prematurely fail. The spring clip 1303 may be configured to prevent an axial movement of the shank 1301 within the bore

1401. Further, the interference of the press fit between the complementary tapered surfaces of the shank and inner bore surface may be configured to prevent rotation of the shank 1301 with respect to the bore 1401. Thus, the spring clip may be used in combination with the tapered surfaces to provide a pick that is substantially stationary with respect to the block during an excavating operation.

The shank 1301 may comprise a proximal thickness 1306 and a distal thickness 1307. The distal thickness 1307 may be configured to be thinner than the proximal thickness 1306. The spring clip 1303 may be configured to be concentric with the distal thickness 1307 and disposed at a distal end 1308 of the shank 1301. The proximal thickness 1306 may be disposed forward of the spring clip 1303. The proximal thickness 1306 may be configured to come into surface contact with the inner surface of the bore 1401. The surface contact may prevent rotation of the shank 1301 within the bore 1401 at a proximal end of the shank 1301. The distal thickness 1307 may be configured to decrease surface contact between the outside surface of the shank 1301 and the inner surface of the bore 1401. In some embodiments, a complete interruption in the surface contact may occur. The reduction or interruption in surface contact may decrease friction between the shank 1301 and bore 1401 upon insertion into the bore. The decreased forces may contribute to an easier removal of the shank 1301 from the bore 1401 during replacement and less time required for removing and reinstalling a pick 1300.

The pick may be used on a variety excavating machines. The blocks may be secured to machines' driving mechanism, which may be a rotary drum, saw blade, rotary chain, bucket, plow, indentor, bit, wedge, blade, or combination thereof.

Whereas the present invention has been described in particular relation to the figures attached hereto, it should be understood that other and further modifications apart from those shown or suggested herein, may be made within the scope and spirit of the present invention.

What is claimed is:

1. A pick comprising:

a shank configured to be press fit directly within a bore of a block;

the shank comprising an inside and an outside surface;

a head opposite the shank;

the shank also comprising at least one longitudinal recess extending towards the head along the shank from a distal end of the shank;

wherein the recess allows the shank to resiliently collapse upon insertion into the bore while maintaining a press fit between the bore and the shank; and wherein the at least one recess comprises a first and second recess wall connected by a spring formed in a material of the shank.

2. The pick of claim 1, wherein the at least one recess is formed on the inside surface of the shank.

3. The pick of claim 1, wherein the at least one recess is formed on the outside surface of the shank.

4. The pick of claim 1, wherein the outside surface is continuous.

5. The pick of claim 1, wherein the inside surface is continuous.

6. The pick of claim 1, wherein the at least one recess is formed through part of a thickness between the inside and outside surfaces.

7. The pick of claim 1, wherein the at least one recess is configured to relieve tension between the shank and the bore.

8. The pick of claim 1, wherein the shank comprises a first thickness and a second thickness along the length of the shank.

9. The pick of claim 8, wherein the first and second thicknesses are configured to secure the shank within the bore at a proximal end and the distal end of the shank.

10. The pick of claim 8, wherein the first and second thicknesses are configured to increase the compliancy of the shank.

11. The pick of claim 1, wherein the shank comprises a tapered region on the outside surface that is configured to abut a tapered region on an inner surface of the bore, wherein the tapered regions are complementary.

12. The pick of claim 1, wherein the shank is hollow.

13. The pick of claim 1, wherein the head comprises a cemented metal carbide substrate bonded to sintered polycrystalline diamond.

14. The pick of claim 13, wherein the substrate is bonded to a bolster and the bolster is brazed to a body of the pick, wherein at least one void is formed along a non-planar interface between the bolster and the body.

15. The pick of claim 14, wherein the non-planar interface is configured to prevent residual thermal stress formation.

16. The pick of claim 1, wherein the shank is substantially stationary with respect to the bore.

* * * * *